US010881256B1

(12) United States Patent
Luque, Jr.

(10) Patent No.: US 10,881,256 B1
(45) Date of Patent: Jan. 5, 2021

(54) RETRACTABLE PLATFORM

(71) Applicant: Ronald Frank Luque, Jr., Valencia, CA (US)

(72) Inventor: Ronald Frank Luque, Jr., Valencia, CA (US)

( * ) Notice: Subject to any disclaimer, the term of this patent is extended or adjusted under 35 U.S.C. 154(b) by 161 days.

(21) Appl. No.: 14/598,509

(22) Filed: Jan. 16, 2015

Related U.S. Application Data

(60) Provisional application No. 61/929,065, filed on Jan. 19, 2014, provisional application No. 62/080,324, filed on Nov. 16, 2014.

(51) Int. Cl.
*A47K 17/02* (2006.01)

(52) U.S. Cl.
CPC ..... *A47K 17/028* (2013.01)

(58) Field of Classification Search
USPC ..... 182/223, 33.5, 33; 297/432.2, 423.38, 297/432.19; 4/254
See application file for complete search history.

(56) References Cited

U.S. PATENT DOCUMENTS 1,681,879 A * 8/1928 Putnam ..... A47C 12/02 182/33.5
4,584,725 A * 4/1986 Oliver ..... A47K 17/028 4/254
5,553,334 A * 9/1996 Hillman ..... A47K 13/10 4/249
6,715,161 B1 * 4/2004 Depoe, Jr. ..... A47K 17/026 4/254
7,503,081 B2 * 3/2009 Montgomery ..... A47K 13/307 4/213
2011/0247898 A1 * 10/2011 Wigutoff ..... E04G 1/28 182/223
2013/0192925 A1 * 8/2013 Chitayat ..... A47C 12/00 182/152
2013/0318698 A1 * 12/2013 Schilpp ..... A47K 17/02 4/254

* cited by examiner

*Primary Examiner* — Lauren A Crane
(74) *Attorney, Agent, or Firm* — Italia IP; James A. Italia

(57) ABSTRACT

A retractable platform for use in conjunction with a toilet seat configured to be compact when in the retracted position. The retracted platform becomes a generally leveled standing platform when engaged in the opened position providing a stable platform for a child to stand on and turn around to position oneself to sit on a toilet seat. When the platform is in the retracted position, it allows an adult to sit on a toilet seat without any obstruction from the stool to their legs or feet. A cut out on its front panel receive adult-sized feet so the platform in the retracted position does not have to be physically moved when an adult needs to use the toilet. The retracted platform can be easily moved to assist a child needing a vertical advantage in a different location.

18 Claims, 8 Drawing Sheets

RETRACTABLE PLATFORM

CROSS-REFERENCE TO RELATED APPLICATIONS

This Non-Provisional Patent Application claims the benefit of U.S. Provisional Application Ser. No. 61/929,065, filed on Jan. 19, 2014, and 62/080,324, filed on Nov. 16, 2014, the contents of which are incorporated herein by reference.

FIELD OF THE INVENTION

The present invention relates to platforms, and more particularly to an improved construction particularly to a lightweight platform where there are telescoping segments which may be placed in the front portion of a toilet to assist small children and the elderly in using the toilet, the platform may be used as a conventional platform for other uses.

BACKGROUND OF THE INVENTION

There are many types of designs for platforms. Most of these consist of multiple segments such as a lower segment and an upper segment. Platforms with multiple segments are often large and bulky and not ideal for storing in small bathrooms. In addition, such platforms inhibit use of the toilet by an adult, causing the adult to move the platform and not returning it to its original place, in which case the child cannot use the platform immediately. Platforms with ascending segments also force children to make addition segments upward which can cause them to lose their balance maneuvering from a lower segment to an upper segment.

A solution to platforms with multiple segments are single platform platforms containing just a single segment. These stools can be stored easily but often have a standing platform which is small in width and length making it difficult for a child to turn around while standing on the platform. An example would be when a child needs to first segment onto the stool in a forward direction and then turn around while standing on the stool to position oneself to sit down on a toilet seat. Children often do not have a good sense of balance and these stools often pose a risk to a child from for falling off these small, single platforms. In addition, a child can lose their balance when trying to pull their pants up or down while standing on the stool due to the limited space of the platform on the stool. These stools are often too narrow causing them to tip over if more weight is distributed on one side of the stool. One fall incident can be terrifying for a young child first learning to toilet train thus hindering their progress at toilet training efficacy.

There exists a need for an inexpensive way to assist small children and the elderly in using the toilet, the platform may be used as a conventional platform for other uses.

SUMMARY OF THE INVENTION

The present invention addresses the above stated need by providing an inexpensive and useful platform which provides a generally leveled platform when in the open position. The platform is configured to be compact when in the retracted position accomplished by an enclosure segment that houses an additional segment inside it, thereby making it ideal for small spaces when not in use.

It is an object of the invention to provide an inexpensive, platform that retracts to make more room when not in use. Moreover, the platform may be used as a conventional platform for other uses.

These and other objects of the present invention will become readily apparent upon further review of the following specification and drawings.

BRIEF DESCRIPTION OF THE DRAWINGS

Various objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION

While the present invention has been described in connection with what is considered the most practical and preferred embodiment, it is to be understood that the present invention is not to be limited to the disclosed arrangements, but is intended to cover various arrangements which are included within the spirit and scope of the broadest possible interpretation of the appended claims so as to encompass all modifications and equivalent arrangements which are possible.

Reference will now be made in detail to various exemplary embodiments of the invention. The following detailed description is presented for the purpose of describing certain embodiments in detail. The present invention may be further illustrated in the following figures, attention being called to the fact, however, that the embodiments described in the description and shown in the figures are illustrative only and are not intended to limit the scope of the invention, and that changes may be made in the specific constructions described in this specification and accompanying drawings that a person of ordinary skill in the art will recognize are within the scope and spirit of the invention. The true scope of the invention is defined by the claims. Further, any features of any embodiment described herein are equally applicable to any other embodiment described herein or envisioned by one of ordinary skill in the art. The detailed description and figures provided herein should not be construed to exclude features otherwise described with respect to another embodiment.

For the purposes of this application, the use of the words "platform" 2 may be interchanged with the words "platform." The use of the words "segments" 4 may be interchanged with the words "segment," and "section." Furthermore, for the purposes of this application, the proximate segment 6 refers to the segment closes to the second object or toilet. The distal segment 4, refers to the segments closes to the user. However, these terms may be interchangeable. In addition, an embodiment of this invention uses the convention that the distal segment extends from the proximate segment, however, another embodiment of the invention may have the proximate segment may extend from the distal segment.

Figure 1:
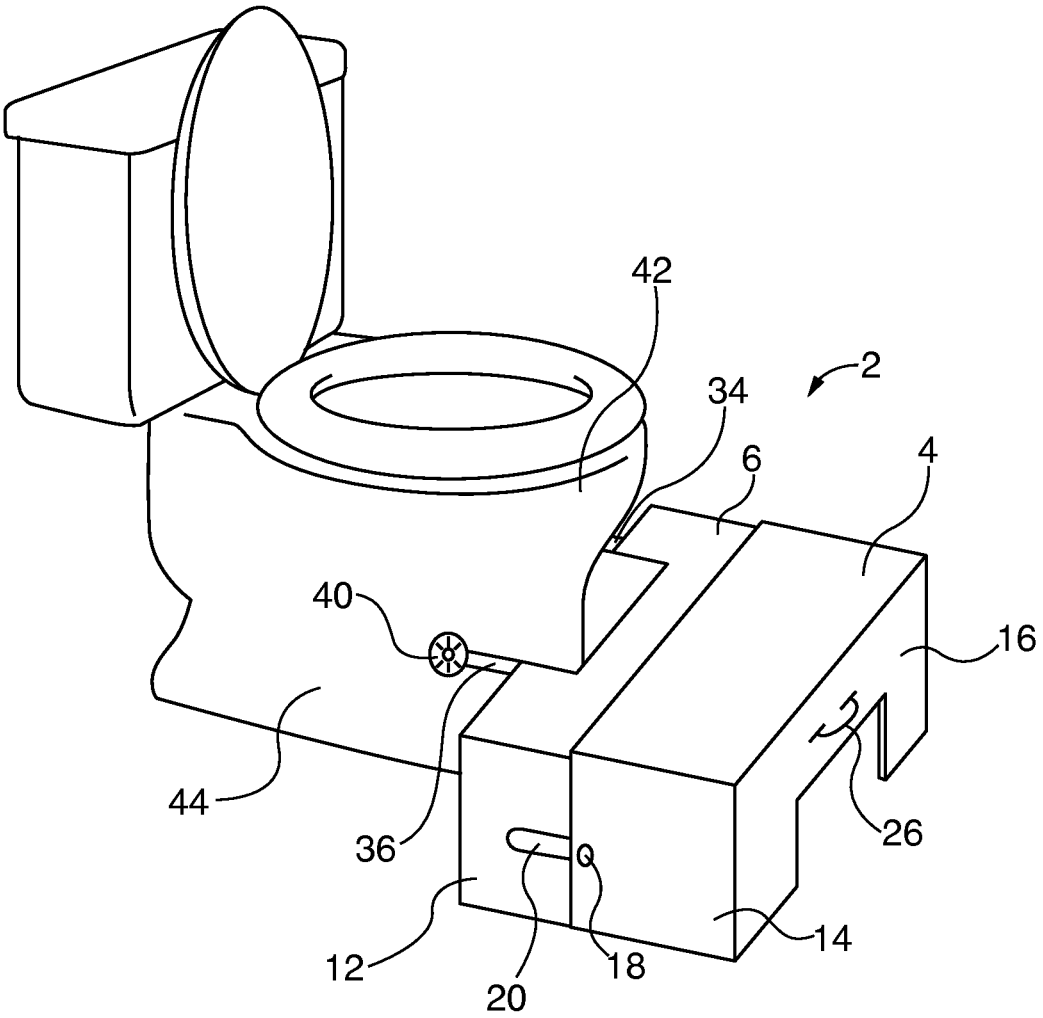
FIG. 1 is a perspective view of the platform according to at least one aspect of the invention.

Referring now to FIG. 1, a retractable platform 2 is depicted. The platform 2 may include a telescoping and horizontally extending platform 2. The platform 2 may have at least two telescoping segments including a proximate segment 4 and a distal segment 6, wherein the telescoping segments are approximately the same dimensions.

The platform 2, may be retracted and extended by pulling the distal segment 4 from said proximal segment 6, where the telescoping segments are able to extend to an extended position by pulling the handle 26. The platform may be retracted to a retracted position and positions between fully extended and retracted. When the telescoping segments 4, 6 are in an extended position, a single aggregate platform 2 of substantially the same height as the proximal and distal segments is created. A single platform is created because the individual segments come together to make a section of the platform. When the telescoping segments 4,6 are in a retracted position, the distal segment 4 will cover the proximal segment 6 by enclosing it.

Referring back to FIG. 1, the figure shows a perspective view of the present invention in an opened position next to a toilet seat base 44. FIG. 1 shows the distal segment 4 fully extended in the opened position with proximate segment 6 adjacent to it. The outward movement of the distal segment 4 is accomplished by pulling handle 26 attached to the front of distal segment 4, specifically the front panel 16, outward.

Further, when the platform 2 is fully extended in its opened position, the top surface platform combines segments, 4,6 to become flat with each other to become a generally leveled platform. The generally leveled platform as seen in FIG. 1 becomes parallel to the ground or surface in which the platform 2 is placed on creating a leveled platform to stand on.

As a non-limiting example, each segment 4, 6 is sufficiently wide, 21 to 25 inches, to allow a wide enough platform for balance and stability for an individual to stand on.

As a further non-limiting example, the length of the platform 2 in the opened position is at 13 inches providing additional balance and stability when a child is standing on the platform segment. The platform 2 is about 8 inches tall which will provide an adequate height for a toddler to segment onto and adequately reach a toilet seat. The 8 inch height of platform 2 is short enough for a toddler to segment onto unassisted once a child has gained the ability to walk alone. The 8 inch height is an approximate height which will provide a vertical advantage for a child to reach a toilet seat.

As another non-limiting example, the material used to construct the segments 4,6 will preferably be a high-strength plastic material but can be constructed from wood, metal, or any suitable material, and can include rubber, ridges, or any other friction-increasing material on its upper or bottom surface to increase safety and better accommodate its intended or alternative uses. The material may be high-strength to support the weight of individuals segments jumping onto it, not just the weight of a child. The material may be light weight to provide easy transportation of the current invention. A thread surface or slip resistant surface may be on the entire segments top platform to prevent slipping by individuals when standing onto platform. The segments may have a slip resistant surface.

As another non-limiting example, proximate segment 6 may have a cutout that partially wraps around a second object such as a toilet. This would allow or a better fit with the second object.

Figure 2:
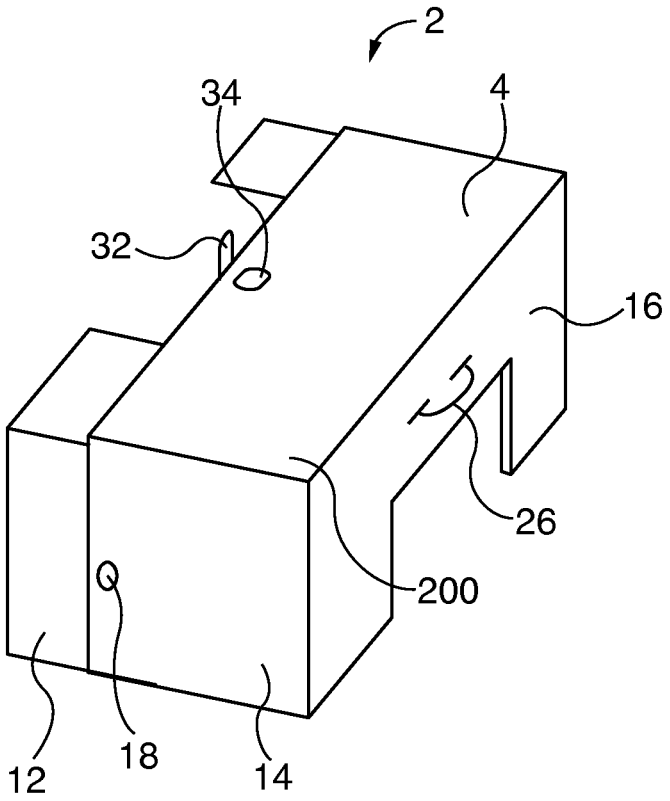
FIG. 2 is a perspective view of FIG. 1 with the platform in the retracted position.
Figure 3:
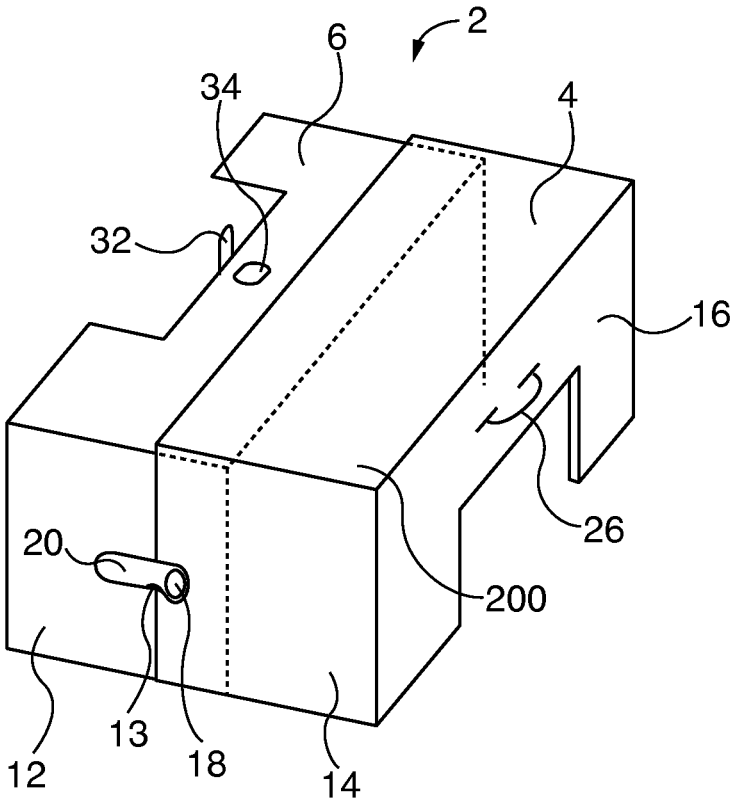
FIG. 3 is a perspective view of FIG. 1 with the platform in the extended position.

Referring now to FIG. 2, the figure shows the platform 2 in a closed or retracted position. FIG. 2 shows how the distal segment 4, which houses or encloses segment 6 when in the closed position. The side panel 14 from enclosure the distal segment 4 contains an attached protrusion-like device 18 facing inward to fit into slide opening 20 on the proximate segment 6. As a non-limiting example, a coupling protrusion-like device 18 to slide opening 20, as seen in FIG. 3, allows the distal segment 4 to move from retracted to opened position by pulling handle 26 outward. The slide opening 20 is an empty space cut out from side panel 12 allowing the protrusions to move horizontally along the slide opening to open and close the platform 2.

Furthermore, a cutout in a forward facing face of said distal segment 4 has purpose. The platform 2 may be left in place when an adult needs to use the toilet. The adult does not need to physically move the stool when platform 2 is not being used, but can leave it in the retracted position at the toilet base 44. In addition, an adult sitting on a toilet seat 42 with the retracted platform 2 at the toilet base 44 will not hinder the adult 40 footing while sitting down on a toilet seat 42. The length of platform may accommodate an adult to sit comfortably without their feet becoming obstructed is about 7½ inches long or less when in the retracted position. The current invention may be constructed so that the total enclosure the distal segment 4 will be approximately 7½ inches long or less when in the retracted position.

Figure 5:
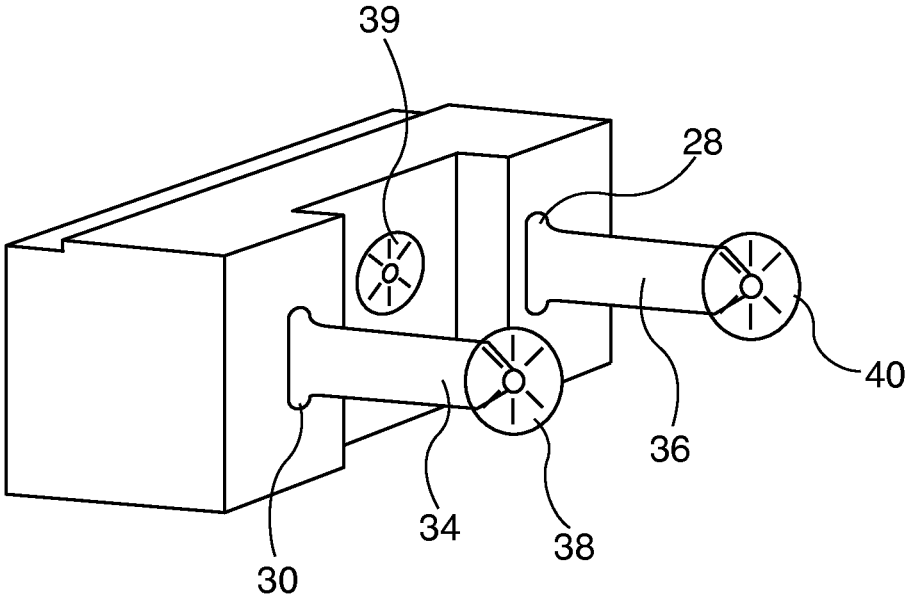
FIG. 5 is a perspective view of FIG. 1 showing the platform from the rear.
Figure 6:
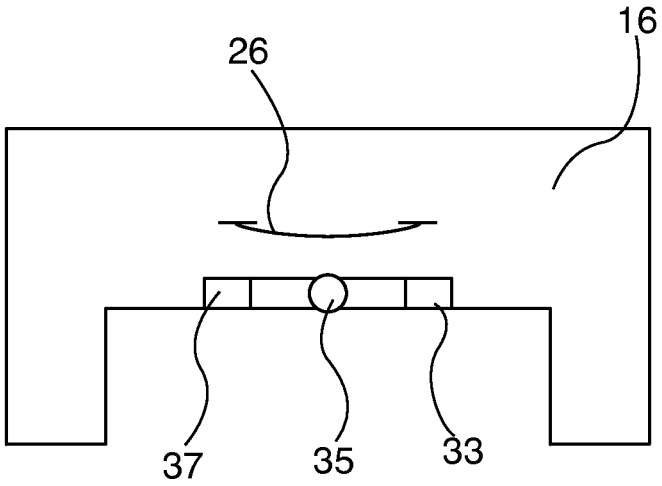
FIG. 6 is a front elevation view of another embodiment the stool segment showing a sensor and light.

Now referring to FIG. 3 a cross-section view of the platform 2 in the opened position is seen. The distal segment 4 is attached to the proximate segment 6 by way of a protrusion-like device 18 facing inward connecting to proximate segment 6 side opening 20. By pulling handle 26 on segment 4 outward, the distal segment 4 is caused to slide forward from the closed position to the opened position. The proximate segment 6 will remain immobile due to attachments 34 and 36 as seen in FIG. 5 attached to a second object. Alternatively, the proximate segment 6 will remain immobile by attaching the proximate segment 6 via suction or attachment 39 as seen in FIG. 5 to toilet base 44 as shown in FIG. 1.

Moreover, as another non-limiting example, each segment 4, 6 may have a length of approximately 6 to 8 inches with the proximate segment 6 being slightly longer than the distal segment 4. The enclosure of distal segment 4 will be approximately 8 inches in height uniformly from front to back. The proximate segment 6 we be less than 8 inches in height for the first 1 inch on its front end and approximately 8 inches tall for their last 7 inches on its backend lengthwise. This result will cause the height of the opened platform 2 to become 8 inches in height uniformly when the distal and proximate segments are fully extended in its opened position. The uniform height of 8 inches for platform 2 is due to overlap with front end of the proximate segment 6 with the back end of the distal segment 4 by an inch. This will cause the platform 2 as seen to be a generally leveled at a height of about 8 inches tall from front to back.

The platform 2 may extend and retract in different ways. The telescoping segments may be a slide mechanism, a rail mechanism, or a spring mechanism.

As a non-limiting example, the slide mechanism would include a protrusion-like device 18 that faces inward and is long enough to fit into slide opening 20. The protrusion-like device 18 is located on the distal segment 4 or more specifically side panel 14. It is located approximately below the center of the side panel 14 towards its rear. The slide opening 20 is located on proximate segment 6 or more specifically the proximate segment 4 has a side panel 12 is located approximately below center to accommodate protrusion-like device 18. The slide opening 20 is a horizontal opening alongside the side panel 12, roughly about 5 inches long or long enough to allow the platform to go from retracted to opened position. The slide opening 20 alongside side panel 12 is roughly about 1 inch high or tall enough to fit the protrusion-like device 18 to fit properly to allow a coupling of distal segment 4 and proximate segment 6. When the platform 2 is in the opened position, it will have a use retention means 13 to hold the platform 2 in the use position to provide stability and prevent unintentional transition to the retracted position.

As a non-limiting example, the rail mechanism the coupling of distal segment 4 to proximate segment 6 may be accomplished by using rail-like device attached to a wheel-like device. This would be similar to the hardware used for sliding cabinet doors. As seen in FIG. 3, more specifically the protrusion-like device 18 and slide opening 20 can be substituted for a rotating wheel and a rail mechanism. The platform 2 will accomplish its same function of retracting and opening to a generally leveled platform once in the opened position with this alternative hardware being used.

As a non-limiting example, the spring mechanism would include a spring attached within the platform 2 to keep the platform in the retracted position. With a push to the front of the distal segment 4, the stool will become automatically opened due to the storing elastic potential energy.

As another non-limiting example, a means for preventing the extension of the segment when the platform is in said retracted position may be added. In FIG. 3, a hook 32 and loop 34 may be used to lock the platform in place.

Figure 4:
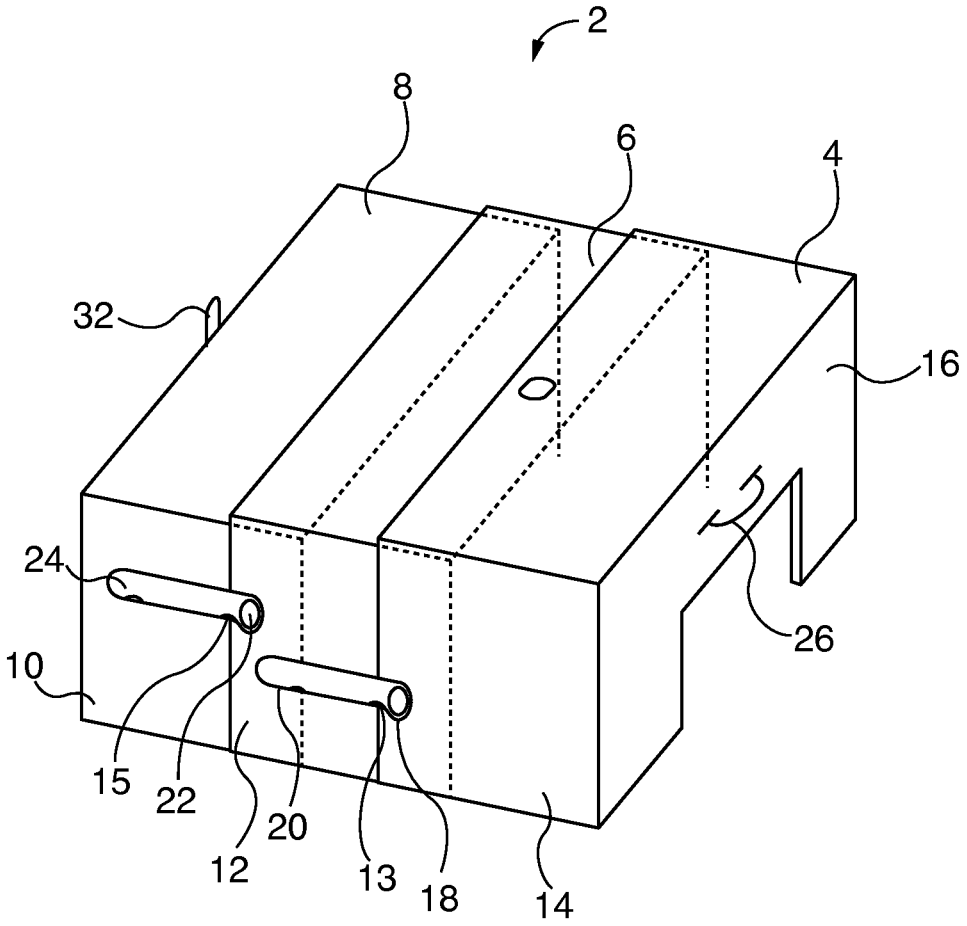
FIG. 4 is a perspective view of another embodiment of the platform with an additional section.

FIG. 4 shows another embodiment of the invention which has an added medial segment 8. The medial segment 8 has substantially the same dimensions of the proximal 6 and distal segment 4. The medial segment is telescopingly situated in between the proximal segment and the distal segment. When the telescoping segments are in an extended position, a single aggregate platform of substantially the same height as the proximal, medial, and distal segments is created.

For the purposes of this application, the alternative embodiments and features of the platform with a distal and proximate segments may extend to the addition embodiment with the medial segment.

Now referring to FIG. 5, the figure shows the back view of the proximate segment 6. The platform 2 includes an anchoring means for securing the proximate segment to a second object, such as a toilet 42. As a non-limiting example, an anchoring means is a suction device 39 configured to allow an attachment to be made to the toilet base. The suction device may be adjustable attachments 34, 36 which can extend out of opening 30 and 28, respectively. The adjustable attachments 34, 36 has a suction device 38 and 40 at the end of each adjustable attachment, respectively. The suction will secure the proximate segment 6 to a stationary object to provide the proximate segment 6 from moving when the distal segment 4 is pulled outward to the open position as seen in FIG. 1. In further detail, the adjustable attachments 34, 36 can be constructed from durable material which can be elongated or shortened as needed. The suction device 38 and 40 can be made of any material that can provide a suctioning function.

Now referring to FIG. 9, the figure shows an alternative embodiment which includes a sensor and lighting system located at the distal segment wherein when a sensor is activated, said lighting system is activated and illuminates the immediate area. The front panel 16 may have a sensor 35 and lighting device 33, 37 to the distal segment 4. The sensor will detect motion which in turn activates the lighting mechanism to provide lighting in a dark environment.

Figure 7:
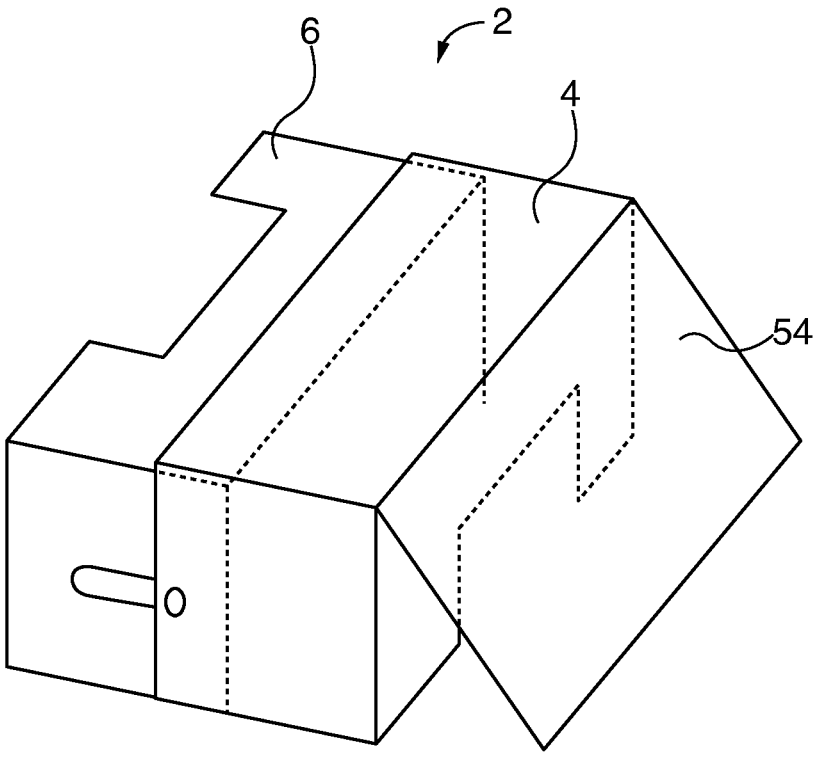
FIG. 7 is a perspective view of another embodiment the stool segment showing a ramp.

Now referring to FIG. 7, the figure shows an alternative embodiment of the current invention with a ramp 54 on the front side of platform 2. The ramp can be attached to the front end of the platform in a fixed position connected to the underside of the distal segment 4 and extending outward. An alternative is to have ramp 54 pull out from the underside of the distal segment 4 by a slide apparatus to fully extend out providing a sloped ramp when in a locked position. An advantage is to provide a ramp enabling a person who is unable to make a direct vertical segment upward to reach the platform, a means to slowly walk up the ramp to stand on the platform.

Figure 8:
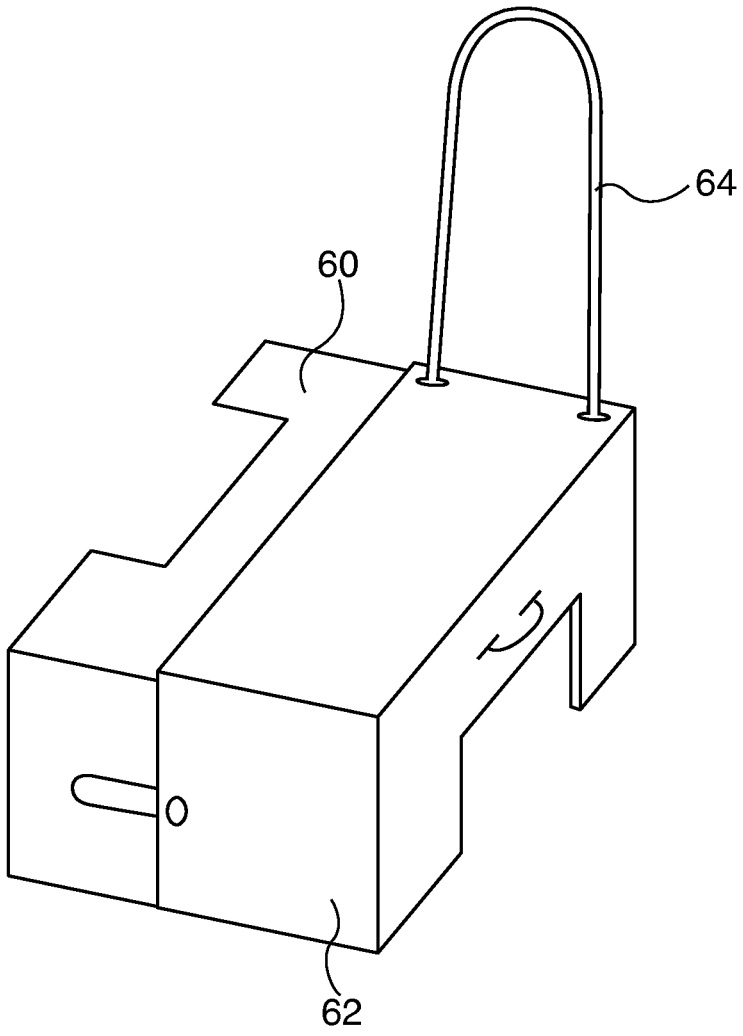
FIG. 8 is a perspective view of another embodiment the stool segment showing a handle.

Now referring to FIG. 8, the figure demonstrates an optional handles 64 which can attach to segment 62 to increase stability when standing on the platform or assisting with standing up from the seated position on the toilet. One handle as shown in FIG. 8 can provide stability for an individual ascending or descending for the platform but alternatively two handrails can provide additional stability and balance for an individual needing assistance stepping onto or off the platform. An additional had rail would be placed on the opposite end on segment 62.

Alternative embodiments and features, which are all non-limiting examples, may include the following.

In the opened position platform 2 may have an approximate length of 13 inches long. The 13 inches includes the length of the platform fully opened when positioned from the base of the toilet 44. The 13 inches in length and 21 to 25 inches width of platform 2 in the opened position allows a large surface area for a child to stand on, move around and feel stable when learning to toilet train. In addition, a child would only need to advance up one segment versus a platform with multiple ascending segments which could cause a child to lose their balance. The fear of falling off the platform is less with the current invention compared to a platform with multiple segments or a platform with a small surface area.

An optional, handle 26 can be made from any material so long as it can be easily grabbed to pull segment 4 outward. The handle will be attached to the front panel 16 of segment 4.

Another option is the platform may be used in a variety of places not limiting its use as a toilet platform. When the platform 2 is placed in front of the bathroom sink cabinet, an opening of platform 2 allows an adult's feet to slide under platform allowing access to bathroom sink. The adult would not need to physically move platform 2 in order to use bathroom sink.

Another embodiment includes use as an exercise segment/bench. In the opened position platform 2 can be used as an exercise platform for use in aerobic exercise programs. The material that will be used to construct the platform will be a high-strength plastic material to support the weight of an individual performing aerobic exercise. An advantage of the present invention allows the platform 2 to be carried easily to an exercise class. The platform 2 reduced size in the retracted position can allow exercise facilities to store the present invention easily without taking up a lot of space in the facility.

Still in a broader example of the present invention, the retractable platform can be used in any aspect of everyday living when one needs to reach or obtain any object in a vertical manner, or perform any task requiring vertical reaching.

While the present invention has been described in connection with what is considered the most practical and preferred embodiment, it is to be understood that the present invention is not to be limited to the disclosed arrangements, but is intended to cover various arrangements which are included within the spirit and scope of the broadest possible interpretation of the appended claims so as to encompass all modifications and equivalent arrangements which are possible.

I claim:

1. A telescoping and horizontally extending platform to be used with a toilet, the platform comprising:

at least two telescoping segments including a proximate segment and a distal segment, wherein the telescoping segments are approximately the same dimensions;

means for retracting and extending said distal segment from said proximal segment; wherein said telescoping segments are able to extend to an extended position, retract to a retracted position and positions therebetween; wherein when said telescoping segments are in an extended position, a single aggregate platform of substantially the same height as said proximal and distal segment is created; and wherein when said telescoping segments are in said retracted position, said distal segment substantially covers said proximal segment, wherein the proximate segment has a cutout that partially wraps around the toilet.

2. The platform of claim 1 further comprising an anchoring means for securing said proximate segment to the toilet.

3. The platform of claim 2 wherein the anchoring means is a suction holder.

4. The platform of claim 1 further comprising a means for preventing the extension of said segment when said platform is in said retracted position.

5. The platform of claim 1 further comprising a sensor and lighting system located at the distal segment wherein when said sensor is activated, said lighting system is activated and illuminates the immediate area.

6. The platform of claim 1 further comprising a ramp at said distal end.

7. The platform of claim 1 further comprising handles to assist the user to segment on said platform.

8. The platform of claim 1 wherein the means for extending and retracting the telescoping segments is selected from a group consisting of a slide mechanism, a rail mechanism, and a spring mechanism.

9. The platform of claim 1 further comprising a cutout in a forward facing face of said distal segment.

10. The platform of claim 1 further comprising a medial segment; wherein said medial segment has substantially the same dimensions of said proximal and distal segments; wherein said medial segment is telescopingly situated between said proximal segment and said distal segment; wherein when said telescoping segments are in an extended position, a single aggregate platform of substantially the same height as said proximal segment, said medial segment, and said distal segments is created.

11. The platform of claim 10 further comprising an anchoring means for securing said proximate segment to the toilet.

12. The platform of claim 11 wherein said anchoring means is a suction holder.

13. The platform of claim 10 further comprising a means for preventing the extension of said segment when said platform is in said retracted position.

14. The platform of claim 10 further comprising a sensor and lighting system located at the distal segment wherein when said sensor is activated, said lighting system is activated and illuminates the immediate area.

15. The platform of claim 10 further comprising a ramp at said distal end.

16. The platform of claim 10 further comprising handles to assist the user to segment on the platform.

17. The platform of claim 10 wherein the means for extending and retracting the telescoping segments is selected from a group consisting of a slide mechanism, a rail mechanism, and a spring mechanism.

18. The platform of claim 10 further comprising a cutout in a forward facing face of said distal segment.

* * * * *